United States Patent [19]

Matsushima et al.

[11] Patent Number: 4,901,615

[45] Date of Patent: Feb. 20, 1990

[54] ELECTRONIC MUSICAL INSTRUMENT

[75] Inventors: Tadashi Matsushima; Tatsunori Kondo, both of Shizuoka, Japan

[73] Assignee: Kabushiki Kaisha Kawai Gakki Seisakusho, Japan

[21] Appl. No.: 366,245

[22] Filed: Jun. 12, 1989

Related U.S. Application Data

[63] Continuation of Ser. No. 108,065, Oct. 13, 1987, abandoned.

[30] Foreign Application Priority Data

Oct. 16, 1986 [JP] Japan ..... 61-246310

[51] Int. Cl.[4] ..... G10H 1/14; G10H 7/00

[52] U.S. Cl. ..... 84/605; 84/622; 84/675

[58] Field of Search ..... 84/1.01, 1.22, 1.23, 84/1.28

[56] References Cited

U.S. PATENT DOCUMENTS

| | | | |
|---|---|---|---|
| 4,202,234 | 5/1980 | Comeford | 84/1.01 |
| 4,246,823 | 1/1981 | Wachi et al. | 84/1.22 |
| 4,611,522 | 9/1986 | Suzuki | 84/1.01 |
| 4,612,838 | 9/1986 | Nagashima et al. | 84/1.01 |
| 4,779,505 | 10/1988 | Suzuki | 84/1.22 |

*Primary Examiner*—Stanley J. Witkowski
*Attorney, Agent, or Firm*—McGlew & Tuttle

[57] ABSTRACT

A double buffer system of a small storage capacity is employed for reducing the noise generation in musical waveforms. The operations of the buffers are utilized for performing an interpolation between waveforms and between successive sample points of each waveform, whereby the number of sample points of the waveform being read out is increased to smooth its level variation, producing a good quality musical tone as if it were obtained by quantizing the synthesized musical waveform.

5 Claims, 7 Drawing Sheets

(a) NO INTERPOLATION BETWEEN WAVE FORMS (b) INTERPOLATION BETWEEN WAVE FORMS

ELECTRONIC MUSICAL INSTRUMENT

This is a file wrapper continuation of application Ser. No. 108,065 filed Oct. 13, 1987, now abandoned.

BACKGROUND OF THE INVENTION

1. Field of the Invention

The present invention relates to an electronic musical instrument which produces a noise-free, good quality musical tone through utilization of what is called a double buffer system for synthesizing successive different musical waveforms. 2. Description of the Prior Art Heretofore there has been employed a system of the type in which a musical waveform is synthesized by sampling musical waveform data of one cycle at successive sample points and is appended with a corresponding frequency, thereafter being written into a memory in a write time slot and then read out therefrom in a different readout time slot.

With this system it is possible to obtain an electronic musical instrument which employs a memory with a storage capacity of only one cycle and is relatively low-cost.

The prior art system produces a time variant wave whose waveform varies with time. In the case where a new synthesized musical waveform is written into the memory when the immediately preceding synthesized waveform is being read out therefrom, if the former has substantially the same temporal variation as does the latter as depicted in FIG. 8A, that is, if the level difference between the two successive synthesized musical waveforms is small or slight, then no noise will be generated in the resulting musical tone even if the newly written musical waveform is read out at a frequency corresponding thereto.

However, where two successive synthesized musical waveforms greatly differ in their temporal variation as shown in FIG. 8B, that is, where the level difference between them is large, noise will be generated in the musical tone when the newly written musical waveform is read out at the frequency corresponding thereto. Therefore, in the case of synthesizing a musical tone faithful to its original tone, if two successive synthesized waveforms have largely different temporal variations, then an abrupt level change will naturally occur at the attack portion of the resulting musical tone which represents a feature of the original musical tone; and so that it is difficult to faithfully reproduce the musical tone at the attack portion thereof, resulting in a failure to faithfully reproduce the original musical tone.

This defect is attributable to the use of only one waveform memory which is accessed in different time slots for writing thereinto and reading out therefrom successive synthesized waveforms. To obviate the defect of the prior art, the present invention employs two waveform memories which are accessed for write and readout independently of each other so that a synthesized waveform being written into one of them will not be read out when they immediately preceding synthesized waveform is being read out of the other waveform memory.

Furthermore, an interpolation between successive waveforms and an interpolation between successive sample points of each waveform are utilized to complement the capability of a waveform generator. The prior art performs these interpolations, using different circuits. The present invention combines the double buffer system and the interpolation, and performs the both interpolations through use of a common interpolation circuit. This will make the waveform being read out undergo a gentle variation, improving the quality of the resulting musical tone.

SUMMARY OF THE INVENTION

It is therefore an object of the present invention to provide an electronic musical instrument in which synthesized waveforms are written into and read out of two waveform memories independently of each other to obtain a noise-free musical waveform and in which the interpolation between successive waveforms and the interpolation between successive sample points of each waveform are performed by a common interpolation circuit through utilization of interpolation coefficients to obtain good quality of sound beyond the capability of the waveform generator used.

To attain the above object, the electronic musical instrument of the present invention comprises: musical waveform generating means for synthesizing a musical waveform by sampling musical waveform data of one cycle at successive sample points; frequency number generating means for providing a frequency to the synthesized musical waveform available from the musical waveform synthesizing means; waveform memory means which has a first waveform memory into which the synthesized musical waveform is once written from the musical waveform synthesizing means and a second waveform memory from which the immediately preceding synthesized musical waveform written therein is read out at the frequency provided to the waveform by the frequency number generating means, the first and second waveform memories being controlled to switch between write and read modes alternately with each other., and interpolation means for interpolating between the musical waveforms written in the first and second waveform memories.

With the above arrangement, synthesized musical waveforms are written into and read out of different waveform memories at frequencies respectively corresponding thereto. Accordingly, there is no possibility that while a new synthesized musical waveform is being written into a buffer, the immediately previously synthesized waveform is read out therefrom, producing a waveform with an abrupt level change, as referred to above with respect to FIG. 8B. Moreover, the level difference between synthesized waveforms or between successive sample points of each waveform is reduced by interpolating the waveforms written in the waveform memories, thereby ensuring the production of a beautiful musical tone of good quality.

DESCRIPTION OF THE PREFERRED EMBODIMENTS

Figure 1:
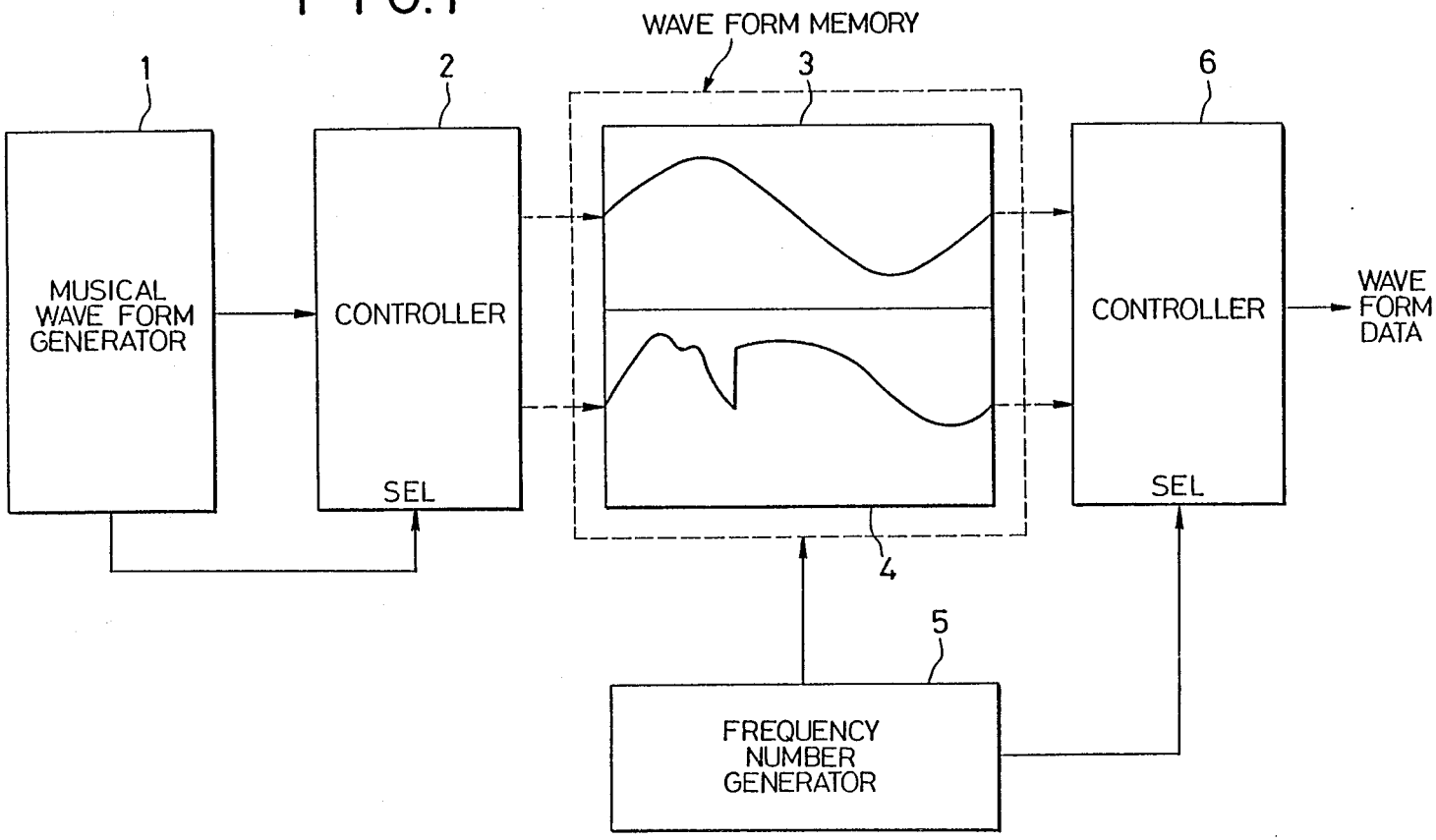
FIG. 1 is a block diagram illustrating the basic circuit structure of the present invention.

FIG. 1 illustrates in block form the basic circuit arrangement of the present invention. In FIG. 1 a musical waveform generator 1 produces a synthesized musical waveform by successively calculating the levels of a musical waveform of one cycle at respective sample points. The synthesized musical waveform thus obtained is provided to a controller 2. The controller 2 accesses, by a control signal, that one of two waveform memories 3 and 4 which is in a write mode. The waveform memories 3 and 4 are alternately switched between write and read modes. The synthesized musical waveform written in the waveform memory in the write mode is provided with a corresponding frequency by a frequency number generator 5. The frequency number generator 5 applies a control signal to a controller 6, by which the musical waveform provided with the frequency is read out of the waveform memory which is in the read mode.

Figure 2A:
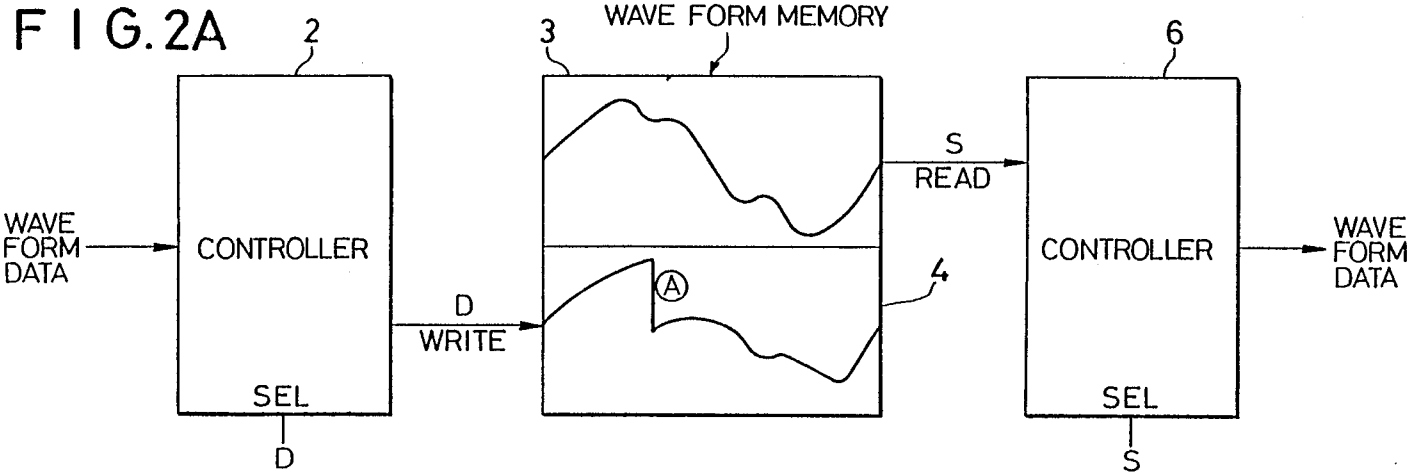
FIGS. 2A and 2B are diagrams for explaining the principal part of the present invention.
Figure 2B:
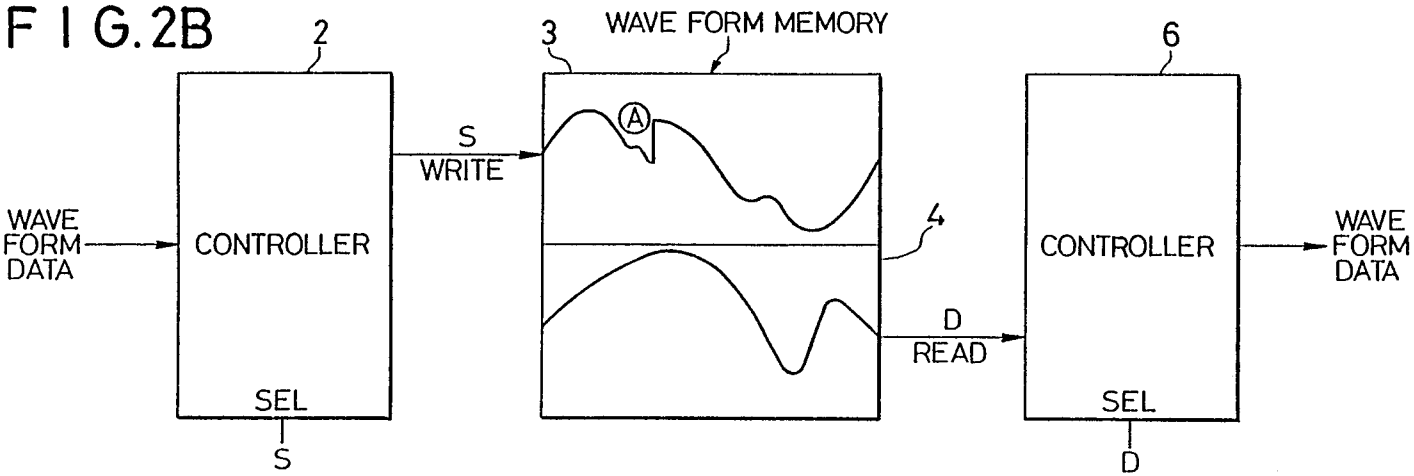

FIGS. 2A and 2B are diagrams for explaining the operations of the waveform memories 3 and 4 which constitute the principal part of the present invention. In FIGS. 2A and 2B there is shown how the waveform memories 3 and 4 are alternately switched between the write and read modes. The waveform memories 3 and 4 will hereinafter be referred to simply as an S buffer and a D buffer, respectively, for convenience of explanation.

In FIG. 2A, waveform data selected by the selector 2 is written into the D buffer 4. At this point, in the case of the aforementioned prior art using only one waveform memory, the waveform written therein has a level difference between it and the immediately preceding waveform as indicated by (A) in FIG. 2A, and when such a waveform is read out, noise will be naturally generated in the resulting in the musical tone as described previously in connection with FIG. 8. In the present invention, however, the immediately preceding waveform is read out of the S buffer at a given frequency under control of the controller 6. In this case, there is no level difference between the newly written waveform and the immediately preceding waveform, and accordingly no noise will be produced.

In FIG. 2B, upon completion of the write of the waveform data into the D buffer, the S and D buffers are put in the write mode and the read mode, respectively. That is, new waveform data is written in the S buffer and the waveform data written in the D buffer is read out thereform. In this way, the S and D buffers are alternately switched between the write and read modes. Accordingly, even if there is a level difference between two successive waveforms written in the S and D buffers, they are each read out of the buffer in which it was written; and so that each musical waveform read out of the buffer in the read mode has no level difference between it and the immediately preceding or succeeding waveform, producing a noise-free musical tone.

Figure 8A:
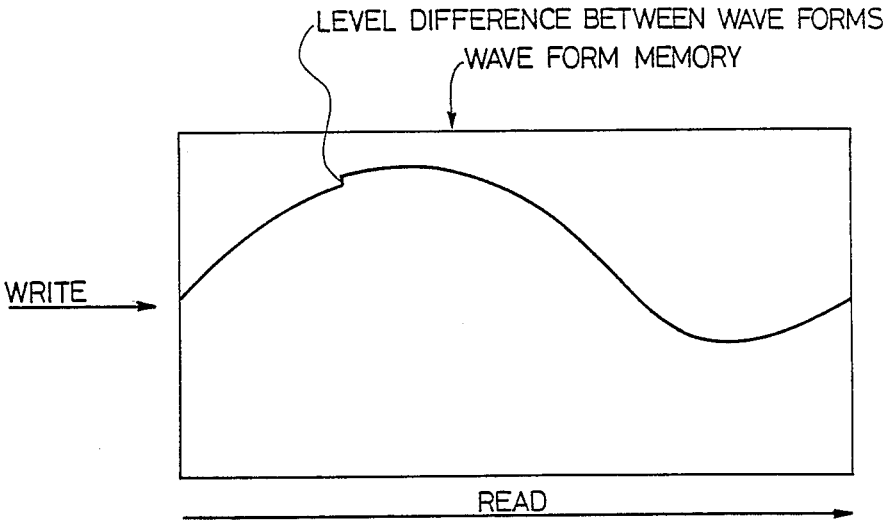
FIGS. 8A and 8B are diagrams for explaining a prior art example.
Figure 8B:
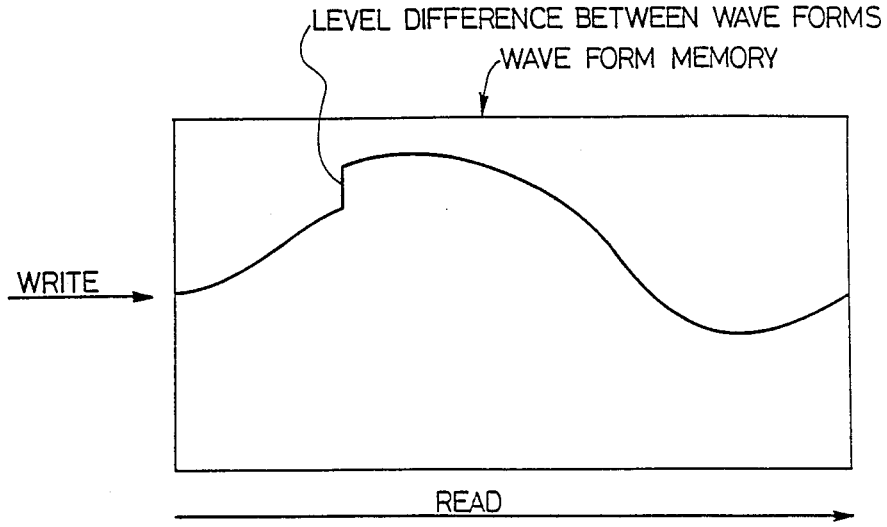

As will be seen from FIGS. 2A and 2B, the present invention calls for a storage capacity twice as large as that is needed in the prior art example shown in FIG. 8. However, a storage capacity of about 256 words will suffice for the waveform data of one cycle and the storage capacity needed in the present invention is 512 words. This number of words is far smaller than in the case of a PCM (Pulse Code Modulation) system or the like.

The above-described system which permits the readout of a musical waveform with no level difference through use of two waveform memories will hereinafter be referred to as as a double buffer system.

In addition to the reduction of noise by the double buffer system, the present invention performs an interpolation between waveforms and an interpolation between successive sample points of each waveform so that the waveforms may vary with time like natural musical waveforms, thereby improving the quality of the resulting musical tone. The interpolation between waveforms and the interpolation between successive sample points will hereinafter be referred to simply as IBWF and IBSS, respectively.

Figure 3A:
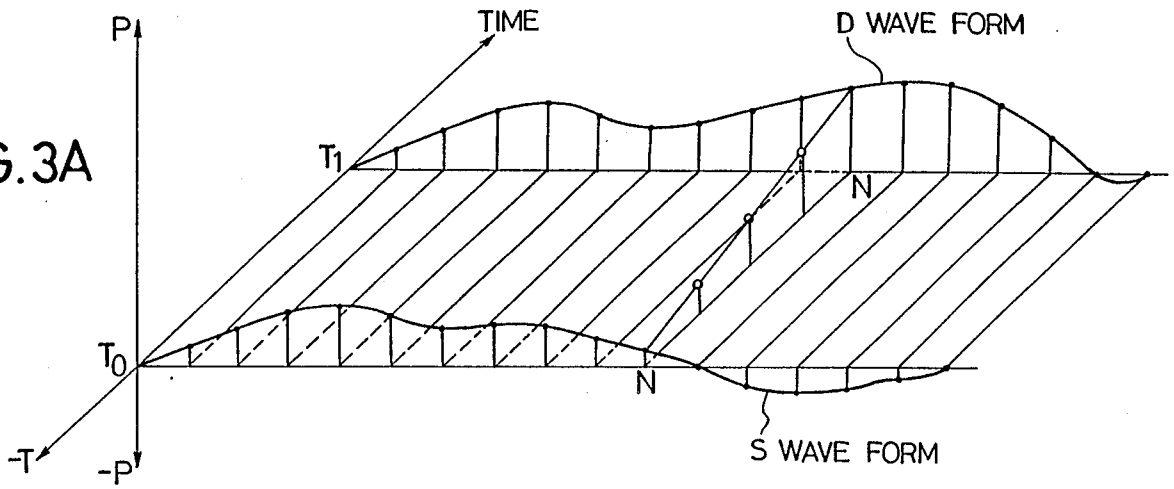
FIGS. 3A and 3B are diagrams for explaining the interpolation between waveforms according to the present invention.
Figure 3B:
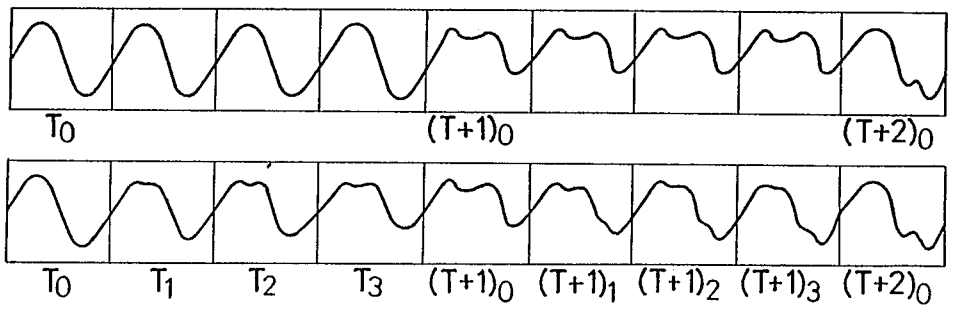

FIGS. 3A and 3B are diagrams for explaining in detail the IBWF and the IBSS, respectively.

In FIG. 3A letting T0 represent the time at which the waveform generator 1 starts to synthesize a waveform and T1 represent the time at which the waveform generator 1 starts to synthesize the next waveform, T1 - T0 is the time in which the waveform generator 1 synthesizes one waveform., in other words, it is the capability of the waveform generator 1. For example, in the case of FIG. 2B, when a waveform S is switched to a waveform D, if the time T1 - T0 is long, then the temporal variation of the resulting musical waveform will be largely different from the temporal variation of a natural musical waveform. When it is desired to increase the number of harmonics which are contained in the synthesized musical waveform, the time T1 - T0 will inevitably increase, with the result that the amount of variation of the waveform will become large, increasing noise in the musical tone being produced. In this instance, by interpolating between the waveforms S and D at some sample points, the time of waveform variation is shortened and the amount of waveform variation is also reduced, decreasing the noise by the waveform variation in the resulting musical tone. FIG. 3A shows that the waveforms S and D are interpolated linearly at four stages from an Nth point of the former to an Nth point of the latter.

FIG. 3B(*a*) shows the variation of a waveform read out without being subjected to the IBWF; in this instance, the waveform varies at times T0, (T+1)1 and (T+2)0. FIG. 3B (B) shows the variation of a waveform read out after being subjected to the IBWF at four points. In this case, as will be seen from FIG. 3B(B), the waveform varies at times T1, T2 and T3 in the time interval between T0 and (T+1)0 and at times (T+1)1, (T+1)2 and (T+1)3 in the time interval between (T+1)0 and (T+2)0; namely, the waveform has variation points four times larger than the waveform shown in FIG. 3B(*a*).

As will be appreciated from the above, the IBWF is very effective for improving the quality of musical tone, and the double buffer system is requisite for implementation of the IBWF.

Another method for improving the quality of musical tone without modifying the capability of the waveform generator 1 is the IBSS.

Figure 4:
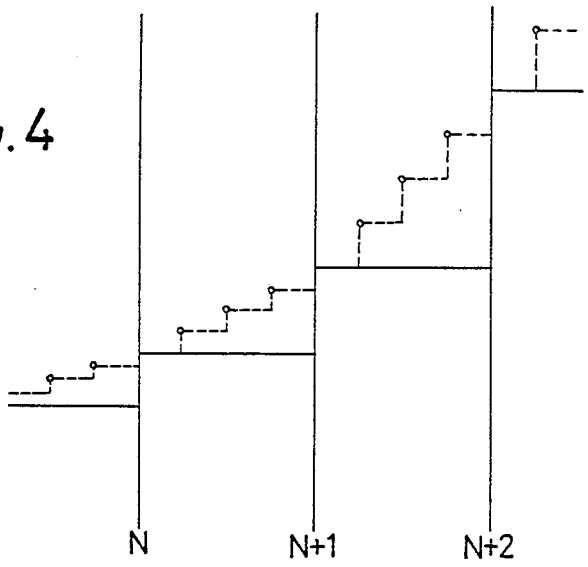
FIG. 4 is a diagram for explaining the interpolation between successive sample points of a waveform according to the present invention.

In FIG. 4, Nth, (N+1)th and (N+2)th sample points of a stored waveform are indicated by black dots, and white dots indicate the points at which the waveform is linearly interpolated between the sample points. In this case, the interpolation is performed at four points, but the IBSS is essentially equivalent to an increase the number of sample points of the waveform, and hence will reduce the noise generation, improving the SN ratio of the waveform.

Figure 5:
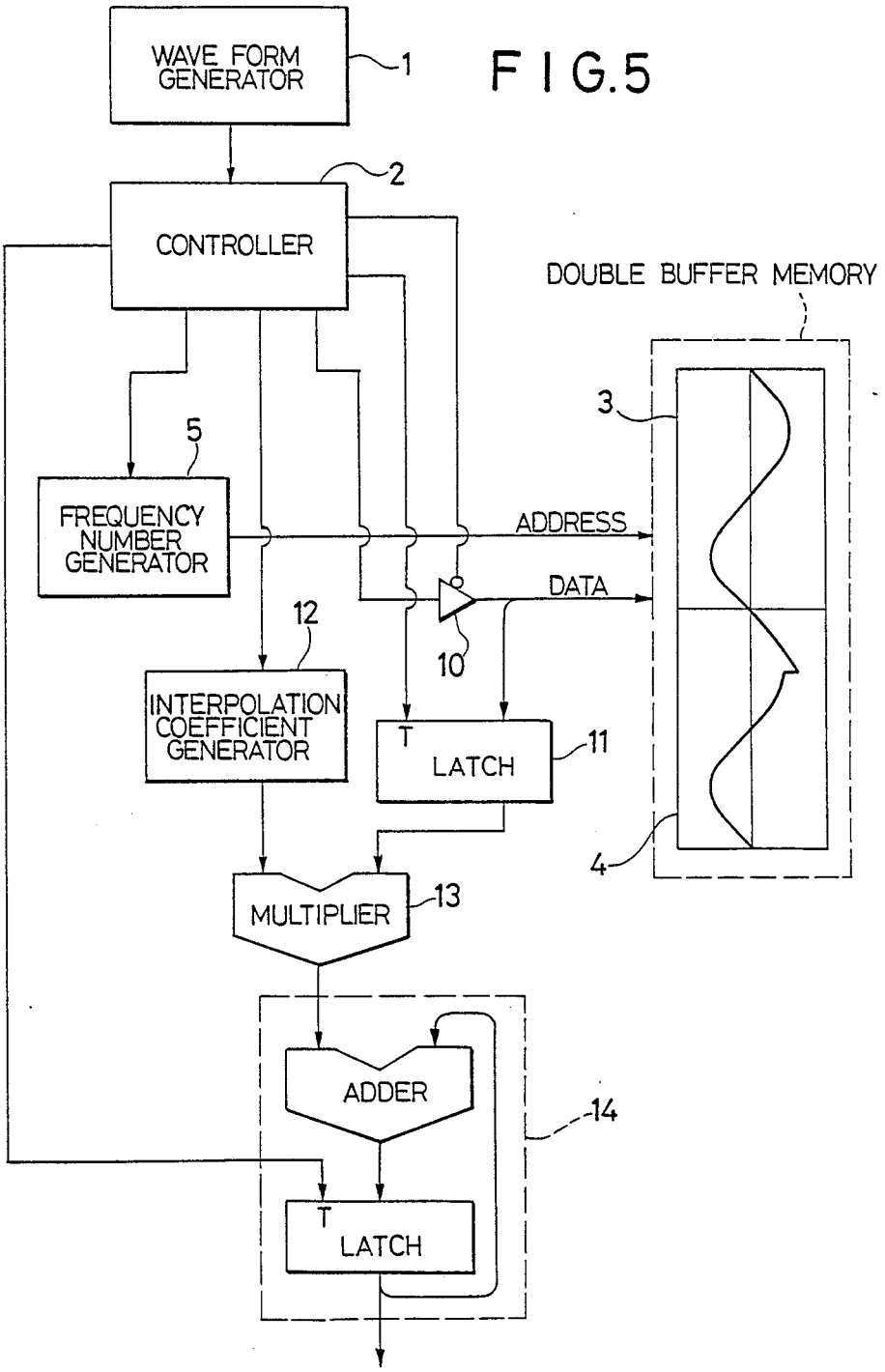
FIG. 5 is a block diagram illustrating the arrangement of an embodiment of the present invention.

FIG. 5 illustrates in block form the arrangement of an embodiment of the present invention. The musical waveform generator 1 calculates the musical waveform data of one cycle and synthesizes a musical waveform, which is provided to the controller 2. The controller 2 accesses, by a control signal, either one of the buffers 3 and 4 for writing therein the synthesized musical waveform. Between the controller 2 and the buffer 3 and 4 there is provided a tri-state gate 10, by which the S and D buffers are switched at same number sample points of the input waveform data thereinto as shown in FIGS. 2A and 2B and the output data therefrom is latched in a latch circuit 11 in synchronism with the switching of the buffers. In response to the output an interpolation coefficient generator 12 generates an interpolation coefficient for performing the IBWF and the IBSS in the buffers 3 and 4. The frequency number generator 5 responds to a timing signal from the controller 2 to provide an address to that one of the buffers 3 and 4 which is in the read mode. Sample point data in the latch circuit 11 and the interpolation coefficient from the interpolation coefficient generator 12 are multiplied in a multiplier 13. The multiplied output is applied to an accumulator 14 made up of an adder and a latch circuit. The accumulator 14 accumulates the multiplied outputs from the multiplier 13 in accordance with a timing signal from the controller 2.

Figure 6:
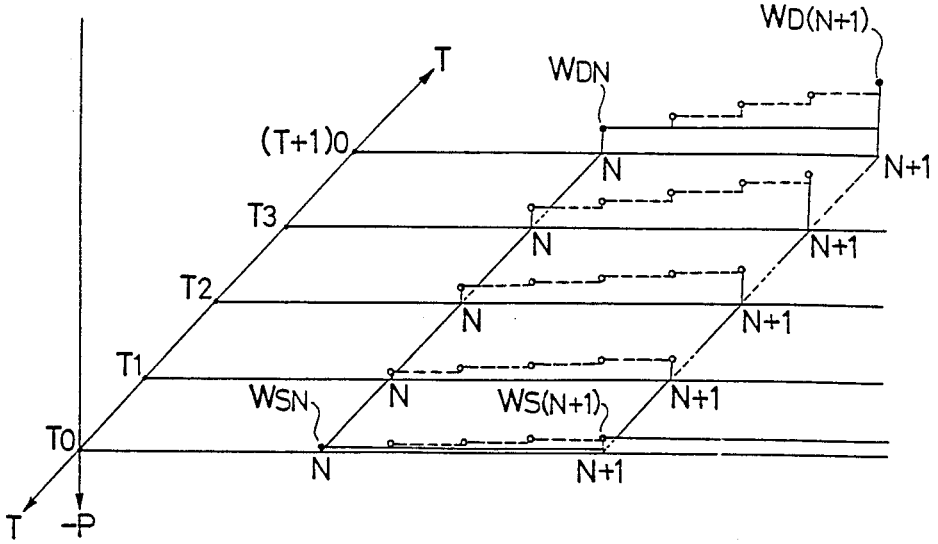
FIG. 6 is a diagram for explaining the both interpolations in the embodiment of the present invention.

Now, a description will be given of an example which employs the double buffer system for eliminating the generation of noise resulting from the level difference between two successively written waveforms and performs the IBWF and the IBSS for reducing the generation of noise resulting from the variation of each waveform. Waveform data obtained by performing the IBWF and the IBSS at four points is given by the following equation:

FIG. 6 is a diagrammatic representation of the IBWF and the IBSS of above waveforms. Black circles indicate the points WSN, WS(N+1), WDN and WD(N+1) and white circles interpolated sample points.

Based on the waveform read address ADD from the frequency number generator 5, the interpolation coefficient generator 12 creates addresses ADDSN, ADDS(N+1), ADDDN and ADDD(N+1) for accessing the S and D buffers to read out herefrom the waveform form data at the points N and N+1, and further, it provides the following coefficients in Eq. (1) for weighting waveform data at the points WSN, WS(N+1), WDN and WD(N+1) read out using the above-said addresses:

$$\frac{h}{4}\cdot\frac{k}{4},\ \frac{h}{4}\cdot\left(1-\frac{k}{4}\right),\ \left(1-\frac{h}{4}\right)\cdot\frac{k}{4},\ \left(1-\frac{h}{4}\right)\cdot\left(1-\frac{k}{4}\right)$$

These coefficients are multiplied by the read-out waveform data in the multiplier 13, and the multiplied outputs are applied to the accumulator 14, providing the waveform expressed by Eq. (1). The data thus obtained is data at the interpolated sample points.

In this instance, the controller 2 performs the function of a transfer controller for transferring a new synthesized waveform from the musical waveform generator 1 to the buffer 3 or 4. That is, since the synthesized waveform varies with time, it must be transferred regularly to either one of the buffers, and if the calculation of Eq. (1) is performed in the course of the transfer of the waveform, the aforementioned level difference will remain as noise. To avoid this, the controller 2 writes the new synthesized waveform into either one of the S and D buffers while the waveform in the other buffer is subjected to the IBWF.

$$\frac{h}{4}\cdot\frac{k}{4}\,WSN+\frac{h}{4}\cdot\left(1-\frac{k}{4}\right)WS(N+1)+\left(1-\frac{h}{4}\right)\cdot\frac{k}{4}\,WDN+\left(1-\frac{h}{4}\right)\cdot\left(1-\frac{k}{4}\right)WD(N+1) \quad (1)$$

In the above:

h=0, 1, 2, 3: number of interpolations between successive sample points k=0, 1, 2, 3: number of interpolations between waveforms N: number of sample points of waveform data (Where the number of sample points is X and N=X, N+1 is 0.)

WsN: sample value at Nth point in the S buffer

Ws(N+1): sample value at (N+1)th point in the S buffer

WDN: sample value at Nth point in the D buffer

WD(D+1): sample value at (N+1)th point in the D buffer

When the waveform in the S buffer and the waveform in the D buffer are subjected to the IBWF and IBSS, the former is interpolated between the points WSN and WS(N+1) and the latter between the points WDN and WD(N+1).

Next, a description will be given of one of some other methods for implementing the IBWF and the IBSS in the system shown in FIG. 5.

In the case of the IBWF and the IBSS at four points as in the above, if the respective coefficients are defined as given in Eq. (1), the IBSS's of the waveforms in the S and D buffers are as follows:

$$WSN+(WS(N+1)-WSN)\frac{h}{4} \quad (2)$$

$$WDN+(WD(N+1)-WDN)\frac{h}{4} \quad (3)$$

This method is the easiest to understand the interpolation in which the level difference between the waveforms at the points N and N+1 is obtained and is multiplied by the coefficient h/4, i.e. a numerical value representing the progress of the interpolation, and the multiplied value is added to the waveform level at the point N. When the values given by Eqs. (2) and (3) are subjected to the IBWF, it follows that $$WSN + (WS(N+1) - WSN)\frac{h}{4} + \left\{ WDN + (WD(N+1) - WDN)\frac{h}{4} - \left[ WSN + (WS(N+1) - WSN)\frac{h}{4} \right] \right\}\frac{k}{4} \quad (4)$$

Eqs. (2), (3) and (4) can be simplified as follows:

$$A+(B-A)C \quad (5)$$

where A corresponds to amplitude data at the point N, B corresponds to amplitude data at the point (N+1) and C is the numerical value representing the progress of interpolation.

Figure 7:
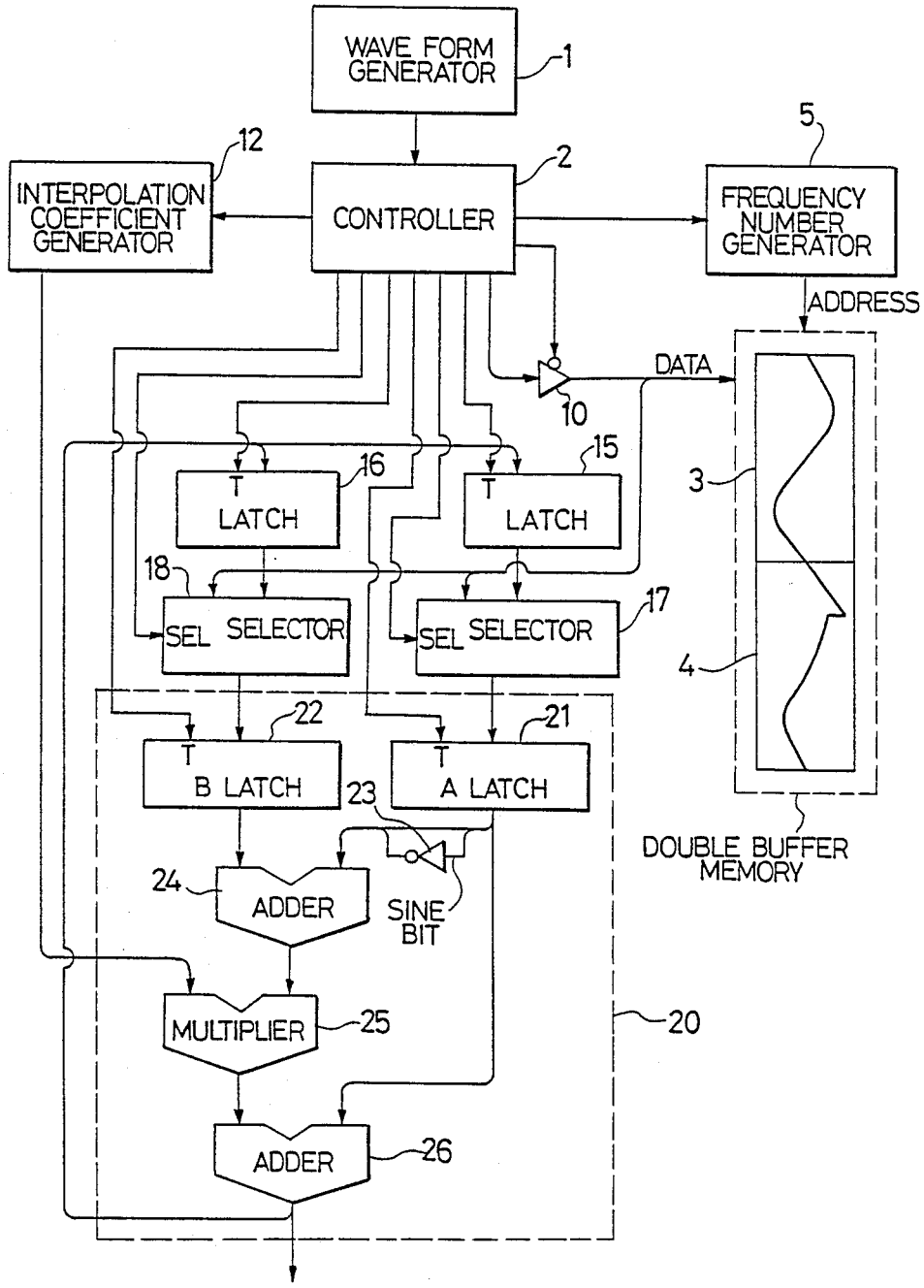
FIG. 7 is a block diagram illustrating the arrangement of another embodiment of the present invention.

FIG. 7 illustrates in block form the arrangement of another embodiment of the present invention, which is provided with a waveform generator for performing a calculation of the type of Eq. (5) and which performs the calculations of Eqs. (2), (3) and (4) on a time-shared basis, thereby implementing the IBWF and the IBSS.

In this embodiment the musical waveform generator 1, the controller 2, the buffers 3 and 4, the frequency number generator 5, the interpolation coefficient generator 12, and the tri-state gate 10 are identical with those used in the embodiment shown in FIG. 5. The interpolation coefficient generator 12 produces the interpolation coefficient h/4 or k/4. The outputs from the buffers 3 and 4 are applied in parallel to selectors 17 and 18, wherein the waveforms from the S and D buffers are selected respectively. Calculation data corresponding to the selected waveforms, from a waveform generator 20 which performs the calculation of Eq. (5), is fed back to latches 15 and 16 and latched therein in synchronism with timing signals from the controller 2. The outputs of the latches 15 and 16 are provided to the selectors 17 and 18, the outputs of which are applied to the waveform generator 20. A latch 21A temporarily stores the value A in Eq. (5), that is data corresponding to the amplitude data at the point N, whereas a latch 22B temporarily stores the value B in Eq. (5), that is, data corresponding to the amplitude data at the point N+1. The data latched in the latch 21A is applied to an inverter 23, wherein its sign bit is inverted. This data and the data latched in the latch 22B are added together in an adder 24, providing (B-A). The output (B-A) and the numerical value C from the interpolation coefficient generator 12 are multiplied in a multiplier 25, obtaining (B-A)C. The multiplied output (B-A)C and the output A of the latch 21A are added together in an adder 26, obtaining A+(B-A)C given by Eq. (5).

In this way, the amplitude data of the waveform at the point N in the S buffer 3 or 4 is read out and is stored in the latch 21A of the waveform generator 20 via the selector 17. Next, the amplitude data of the waveform at the point N+1 is read out and is stored in the latch 22B via the selector 18, and the calculation results obtained by the waveform generator 20 are fed back to the latch 15 for storage therein. The same procedures as mentioned above are carried out for the waveform in the D buffer and the calculation results are stored in the latch 16.

Then, the data stored in the latches 15 and 16 are provided to the waveform generator 20 via the selectors 17 and 18, respectively, after which the same procedures as referred to above are repeated. Also in this instance, the next new synthesized waveform is written into either one of the S and D buffers in the same way as described previously in connection with the embodiment shown in FIG. 5. In other words, when the interpolation has proceeded to its final stage, that is, when the waveform being read out has become the waveform in either one of the S and D buffers, the next new synthesized waveform is written into the other buffer from which the preceding waveform has completely been read out.

As described above, the present invention employs two buffers for reducing the noise when musical waveforms are read out, and utilizes the operations of the buffers for performing an interpolation between waveforms or between successive sample points, whereby the number of sample points of the waveform being read out is increased to smooth its level variation, producing a good quality musical tone.

It will be apparent that many modifications and variations can be effected without departing from the scope of the novel concepts of the present invention.

What is claimed is:

1. A temporally varying musical waveform generating device comprising:

(a) musical waveform generating means which sequentially synthesizes temporally varying musical waveform data through operation and provides an output of the synthesized musical waveform data;

(b) first and second memory means which store, alternately with each other, the musical waveform data sequentially output from the musical waveform generating means;

(c) readout means whereby pluralities of sample values stored in the first and second memory means are read out therefrom in accordance with the frequency of a musical tone to be generated, the readout means sequentially reading out sample values at addresses N and N+1 in the first memory means having stored therein the musical waveform data and sample values at addresses N and N+1 in the second memory means having stored therein musical waveform data different from that stored in the first memory means;

(d) interpolation coefficient generating means for sequentially generating interpolation coefficients corresponding to the sample values in the order in which they are read out of the first and second memory means by the readout means;

(e) multiplying means for multiplying each of the sample values sequentially read out of the first and second memory means by the readout means and the corresponding one of the interpolation coefficients sequentially generated by the interpolation coefficient generating means; and (f) accumulating means for accumulating respective weighted sample values output from the multiplying means;

wherein one interpolated sample value is produced by accumulating the respective weighted sample values by the accumulating means and an interpolation between two different waveforms in the temporally varying musical waveform and an interpolation between successive sample points in the different waveforms are performed simultaneously, thereby generating a temporally varying musical waveform with little noise.

2. A temporally varying musical waveform generating device comprising:

(a) musical waveform generating means which sequentially synthesizes temporally varying musical waveform data through operation every waveform period and provides an output of the synthesized musical waveform data;

(b) double buffer means having two memory areas for temporarily storing the waveform data output from the musical waveform generating means;

(c) switching control means whereby the wave for data output from the musical waveform data generating means is switched so that the waveform data currently output from the musical waveform data generating means is stored in the one of the two memory areas of the double buffer means and the waveform data generating means is stored in the other memory area of the double buffer means;

(d) readout means whereby the currently synthesized waveform data WD and the previously synthesized waveform data WS stored in the two different memory areas of the double buffer means, respectively, are read out therefrom at a rate corresponding to a desired musical frequency, the readout means sequentially applying address N and N+1 to the memory areas of the double buffer means having stored therein the waveform data WD and WS respectively, and reading out therefrom sample values WSN, WS(N+1), WDS and WD(N+1) one after another:

(e) interpolation coefficient generating means for generating interpolation coefficients corresponding to the sample values read out of the double buffer means by the readout means;

(f) multiplying means for multiplying each of the sample values read out of the double buffer means by the readout means and the corresponding one of the interpolation coefficients generated by the interpolation coefficient generating means; and (g) accumulating means for generating an interpolated sample value by accumulating the weighted sample values sequentially output from the multiplying means;

wherein the sample values WSN, WS(N+1), WDN and WD (N+1) in the temporally varying synthesized wave form data WD and WS are interpolated, thereby generating a temporally varying musical waveform with little noise.

3. The device of claim 2, wherein the interpolation coefficients generated form the interpolation coefficient generating means corresponding to the sample values, respectively, are $$\frac{h}{4}\cdot\frac{k^*}{4},\ \frac{h}{4}\cdot\left(1-\frac{k}{4}\right),\ \left(1-\frac{h}{4}\right)\cdot\frac{k}{4},\ \text{and}$$

$$\left(1-\frac{h}{4}\right)\cdot\left(1-\frac{k}{4}\right)$$

wherein h=0, 1, 2, 3: the number of interpolations between samples k=0, 1, 2, 3: the number of interpolations between waveforms, wherein the accumulating means accumulate weighted sample values sequentially output from the multiplying means and performs an operation $$\frac{h}{4}\cdot\frac{k}{4}\cdot WSN+\frac{h}{4}\cdot\left(1-\frac{k}{4}\right)WS(N+1)+$$

$$\left(1-\frac{h}{4}\right)\cdot\frac{k}{4}\,WDN+\left(1-\frac{h}{4}\right)\cdot\left(1-\frac{k}{4}\right)WD(N+1).$$

4. A temporally varying musical waveform generating device comprising:

(a) musical waveform generating means which sequentially synthesizes temporally varying musical waveform data through operation of every waveform period and provides an output of the synthesized musical waveform data;

(b) double buffer means having two memory areas for temporally storing the waveform data output from the musical waveform generating means;

(c) switching control means whereby the waveform data output from the musical waveform data generating means is switched so that the waveform data currently output from the musical waveform data generating means is stored in the one of the two memory areas of the double buffer means and the waveform data output next from the musical waveform data generating means is stored in the other memory area of the double buffer means;

(d) readout means whereby the currently synthesized waveform data WD and the previously synthesized waveform data WS stored in the two different memory areas of the double buffer means, respectively are read out therefrom at a rate corresponding to a desired musical frequency, the readout means sequentially applying addresses N and N+1 to the two memory areas of the double buffer means having stored therein the waveform data WD and WS, respectively, and reading out therefrom sample values WSN, WS(N+1), WS and WS(N+1) one after another;

(e) operating means for operating a general formula A+(B−A)C, the operating means comprising a subtractor for performing a subtraction B−A, a multiplier for multiplying the subtracted output B−A by C to output (B−A)C, and an adder for adding the multiplied output (B−A)C and A;

(f) interpolation coefficient generating means for generating first and second interpolation coefficients;

(g) a first register which supplies the operating means with the sample values WSN and WS(N+1) from the readout means as A and B, respectively, and the first interpolation coefficient from the interpolation coefficient generating means as C and stores the operated output;

(h) a second register which supplies the operating means with the sample values WDN and WD(N+1) from the readout means as A and B, respectively, and the first interpolation coefficient from the interpolation coefficient generating means as C and stores the operated output; and (i) sample value generating means whereby the value stored in the first register, the value stored in the second register and the second interpolation coefficient form the interpolation coefficient generating means are supplied as A, B and C to the operating means, thereby generating one interpolated sample value;

wherein an interpolation between two different waveforms in the temporally varying musical waveform and an interpolation between successive sample points in the different waveforms are performed simultaneously, thereby generating a temporally varying musical waveform with little noise.

5. The device of claim 4, wherein the first interpolation coefficient generated from the interpolation generating means is h/4 and the second interpolation coefficient is k/4 where h=0, 1, 2, 3: the number of interpolation between samples k=0, 1, 2, 3: the number of interpolations between waveforms wherein the sample value generating means performs an operation $$WSN + (WS(N+1) - WSN) \cdot \frac{h}{4} + \left\{ WDN + (WD(N+1) - WDN) \cdot \frac{h}{4} - \left[ WSN + (WS(N+1) - WSN) \cdot \frac{h}{4} \right] \right\} \cdot \frac{k}{4}.$$

* * * * *